US005285603A

United States Patent [19]

Richard et al.

[11] Patent Number: 5,285,603

[45] Date of Patent: * Feb. 15, 1994

[54] METHOD AND APPARATUS TO ENSHROUD LARGE VERTICAL STRUCTURES

[75] Inventors: Louis J. Richard, Dexter; Kenneth M. Richard, Chelsea, both of Mich.

[73] Assignee: K & L Manufacturing, Ltd., Ann Arbor, Mich.

[ * ] Notice: The portion of the term of this patent subsequent to Jul. 23, 2008 has been disclaimed.

[21] Appl. No.: 733,038

[22] Filed: Jul. 22, 1991

Related U.S. Application Data

[63] Continuation-in-part of Ser. No. 531,845, Jun. 1, 1990, Pat. No. 5,033,240.

[51] Int. Cl.[5] ..... E04B 1/343

[52] U.S. Cl. ..... 52/63; 52/5; 52/29; 52/71; 52/745.01; 52/DIG. 12; 52/741.3

[58] Field of Search ..... 52/63, DIG. 13, 71, 52/5, 747, 41, 27, 29, 741, 745.01, DIG. 12; 212/199-200, 204

[56] References Cited

U.S. PATENT DOCUMENTS

| | | | |
|---|---|---|---|
| 1,322,149 | 11/1919 | Swain | 52/63 |
| 1,748,085 | 2/1930 | Shorey | 52/63 |
| 1,759,628 | 5/1930 | Pelleanho | 52/63 |
| 2,768,432 | 10/1956 | Hines | 29/431 |
| 3,140,563 | 7/1964 | Allen | 52/63 |
| 3,556,252 | 1/1972 | Alkins et al. | 212/57 |
| 3,673,754 | 7/1972 | Myrashige | 52/747 |
| 3,715,843 | 2/1973 | Ballinger | 52/DIG. 12 |
| 3,945,106 | 3/1976 | Mays et al. | 52/741 |
| 3,994,108 | 11/1976 | Johnson | 52/63 |
| 4,033,367 | 7/1977 | Johnston | 135/8 |
| 4,106,244 | 8/1978 | Kessler et al. | 52/63 |
| 4,122,648 | 10/1978 | Godwin | 52/749 |
| 4,199,906 | 4/1980 | Jasch et al. | 52/63 |
| 4,364,205 | 12/1982 | Scott | 52/63 |
| 4,683,902 | 8/1987 | Wilson | 52/63 |
| 4,787,173 | 11/1988 | Lewis | 47/21 |
| 4,798,220 | 1/1989 | Smoljo | 52/3 |
| 5,033,240 | 7/1991 | Richard et al. | 52/63 |
| 5,072,553 | 12/1991 | Bozetto et al. | 52/63 |

*Primary Examiner*—Carl D. Friedman
*Assistant Examiner*—Christopher J. Kent
*Attorney, Agent, or Firm*—James M. Deimen

[57] ABSTRACT

Apparatus to temporarily enclose multi-story structures such as municipal water towers during sandblasting and painting to thereby contain the debris and overspray from the environment. A plurality of booms extending in an array outwardly from the top of the structure are temporarily attached to the structure. Hoisting and guide cables extend downwardly from the ends of the booms out beyond the outermost periphery of the structure. A plurality of fabric or plastic panels are supported on a framework in turn attached to guides on the guide cables and the guides are attached to the hoisting cables. The guide cables are anchored to ground. The hoisting cables are connected to a common hoisting engine. The entire assembly of panels can be raised in unison about the structure for daily activities and then lowered at night or quickly lowered in the event of high winds. Apparatus and panels are provided to enclose the top of the structure, to provide adjustable locations for the booms and to cable stay the booms together.

22 Claims, 15 Drawing Sheets

METHOD AND APPARATUS TO ENSHROUD LARGE VERTICAL STRUCTURES

This application is a continuation in part from application Ser. No. 07/531,845, filed Jun. 1, 1990, patented U.S. Pat. No. 5,033,240.

BACKGROUND OF THE INVENTION

The field of the invention pertains to the field of temporarily covering or enclosing objects and structures of large size during treatment or processing and, in particular, to enclosing such objects in a manner that contains and retains materials that otherwise would be released to the environment. Only recently a significant demand for means to cover large objects and structures has arisen because of new rules to prevent the release of old paint, sand blasting materials, new paint overspray and asbestos to the environment.

Means to quickly cover or uncover a large object have been available for many years in a variety of forms such as that disclosed in U.S. Pat. No. 1,759,628 wherein an automobile may be quickly covered and uncovered. More recently U.S. Pat. No. 4,787,173 discloses a means to quickly cover and uncover fruit trees with minimal damage to the trees.

U.S. Pat. No. 4,794,974 discloses a dust curtain for interior protection from dust generated in a portion of an interior room. U.S. Pat. 3,945,106 discloses a means of constructing a natural draft cooling tower by raising a ring on a central tube, the ring having a cable assembly suspended therefrom. The cable assembly supports a larger ring to provide a fixed upper diameter for the tower. The cable configuration provides the proper geometric shape for the cooling tower and a support upon which are attached panels of plastic, metal or asbestos cloth.

The above approaches to enshrouding an object or structure do not suggest means to enshroud structure as large as municipal water towers and petroleum storage tanks. Under new rules being mandated for environmental protection, enshrouding is being required for the sand blasting and painting of such large structures to prevent contamination of the environment with dust, paint chips and paint spray.

SUMMARY OF THE INVENTION

The invention comprises apparatus and method for enshrouding or enclosing multistory structures or buildings such as municipal water towers and large petroleum storage tanks that may be 50 to 250 feet, in height. Recent environmental regulations require that sandblasting debris and paint over-spray be contained and prevented from release to the environment. In practicing the invention a plurality of booms are temporarily attached to the top of the structure so as to extend out beyond the periphery of the structure. Extending downwardly from the boom ends are guide cables and hoisting cables to guide and raise a frame work having a plurality of fabric or plastic panels attached thereto. The guide cables are fastened to the ground and the hoisting cables are fastened to sleeves on the cables, the sleeves serving as the guides. Horizontal telescopic tubes serve to support the panels and extend between the guides and guide cables.

The ends of the booms are equipped with sheaves or pulleys over which the hoisting cables pass. The hoisting cables either extend downwardly from the sheaves directly to one or more hoisting engines or, where the structure is equipped with a central riser, or shaft from ground to roof, the hoisting cables extend generally horizontally to a central multiple sheave assembly and then downwardly to a common down haul cable. The common downhaul cable in turn is connected to a hoisting engine near the base of the structure. When not in use the panels are collapsed and folded at the base of the structure. The entire assembly of panels can be raised in unison about the structure for daily activities and then lowered at night or quickly lowered in the event of high winds. In an alternate embodiment the central multiple sheave assembly permits differing numbers of sheaves to be attached at all points of the compass.

The booms are fitted with a main or central support and wind braces or stabilizers having both telescoping and rotational adjustments in the fittings that attach to the booms and to the structure. The particular adjustability permits the boom assemblies including the central supports and wind braces to accommodate the compound curvature tops of contemporary single leg water towers and traditional multiple leg water towers. The boom assemblies are equipped with pads or feet that are temporarily welded to the steel plate tops of the towers. After the repainting of the tower is otherwise completed the pads are cut free from the tower and the weld locations spot painted. In an alternative embodiment special upright flanges or brackets are permanently welded to the top or roof so that the boom assemblies can be easily pinned or bolted in place when the structure is to be sand blasted and repainted. In another alternative embodiment the booms are cable stayed to adjoining boom foot pads.

At the top of the structure back stay cables connecting the boom ends to the central sheave assembly are used to support fabric or plastic panels. Rectangular panels may be overlapped or radially pleated panels fitted to extend back stay to back stay.

DESCRIPTION OF THE DRAWINGS

FIG. 18-A is a detail of the boom;

DESCRIPTION OF THE PREFERRED EMBODIMENTS

Figure 1:
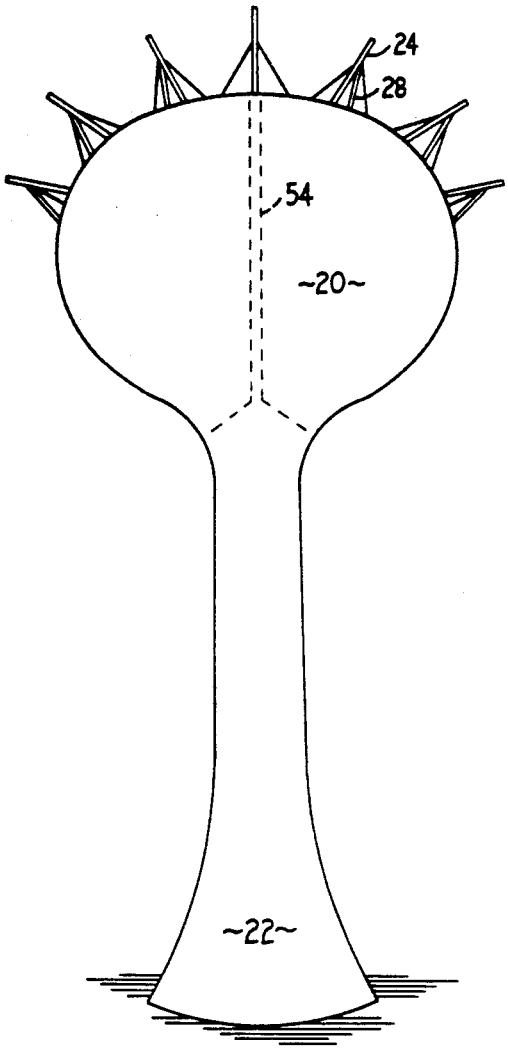
FIG. 1 illustrates a single column water tower equipped with temporary booms.

Illustrated in FIG. 1 is a contemporary water tower 20 commonly in use in the United States. Typically such water towers are 150 to 200 feet in height, constructed of steel plates with welded joints and supported on a flared base 22. The towers are painted to reduce corrosion and improve appearance. The initial painting and periodic repainting requires an initial sand blasting to clean the outer surface prior to spray painting. Considerable debris is released to the air and surrounding ground by the sand blasting and spray painting. The following method and apparatus vertically encloses structures such as a water tower to thereby capture and contain the sandblasting debris and the overspraying of paint.

Figure 2:
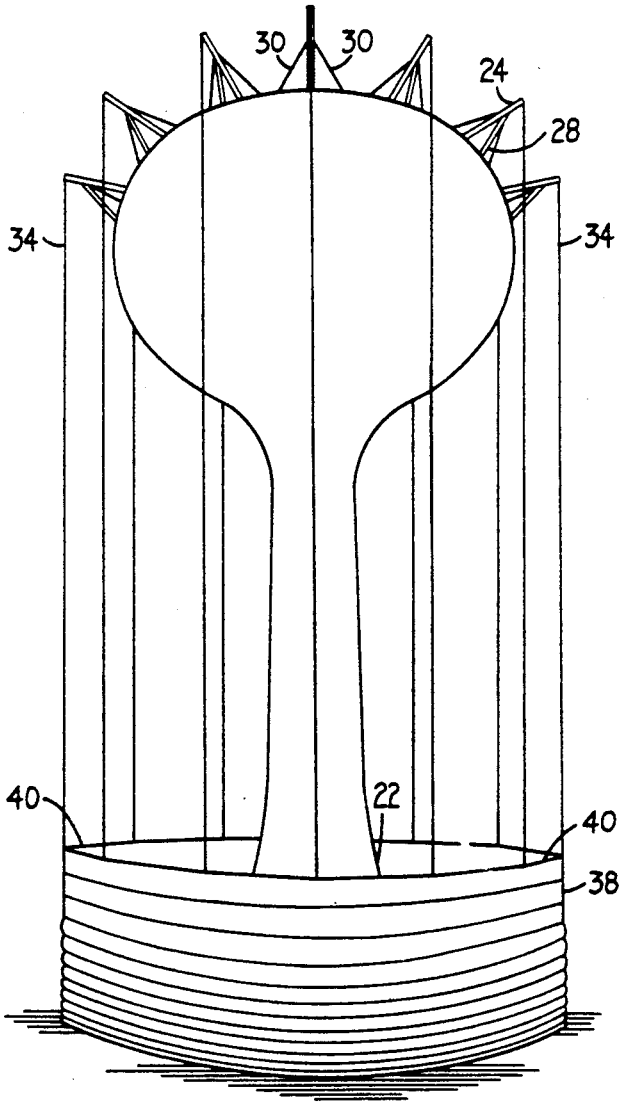
FIG. 2 illustrates the water tower of FIG. 1 with hoisting cables and folded shroud.
Figure 3:
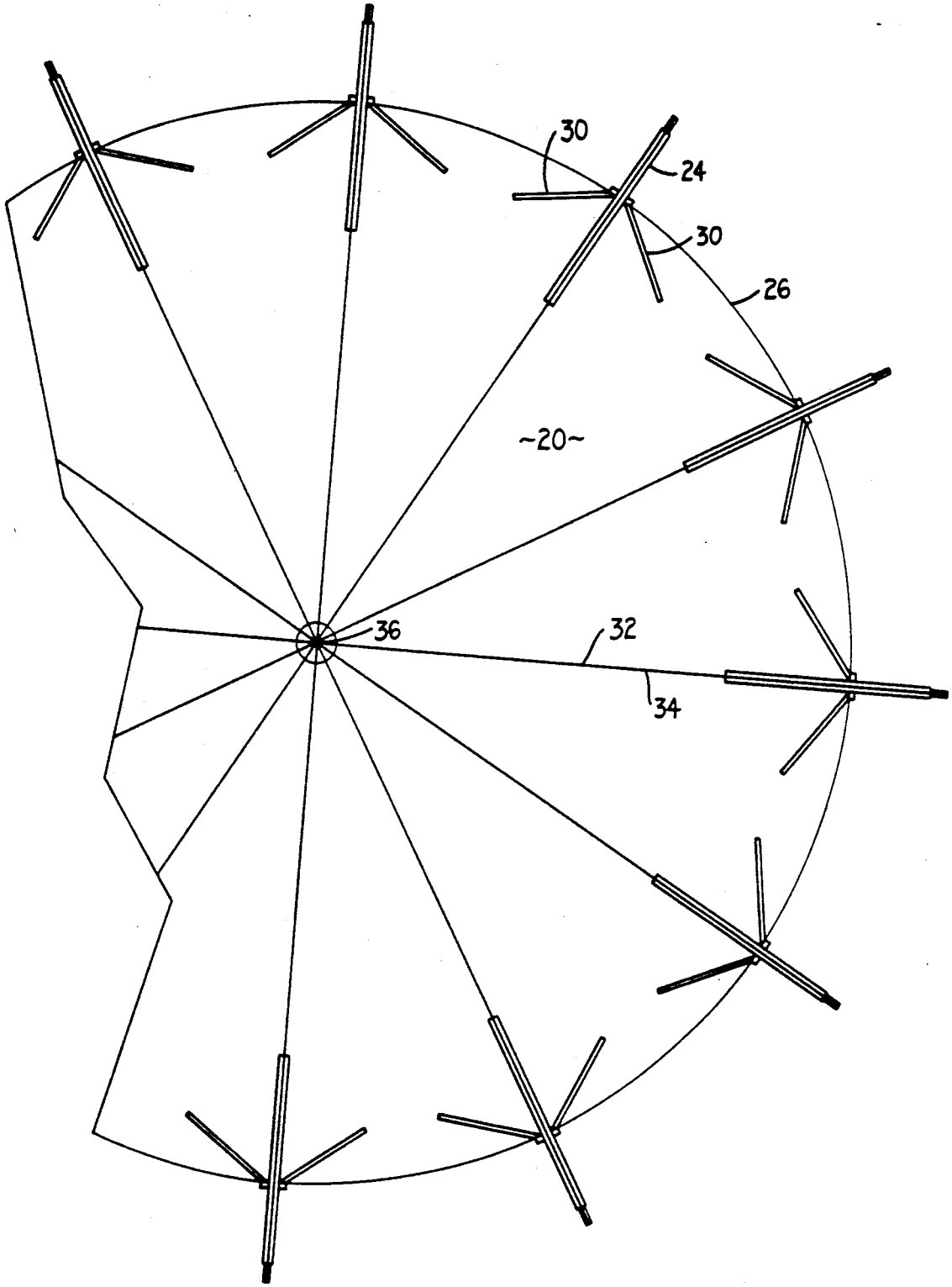
FIG. 3 schematically illustrates in broken away plan view the top of the water tower of FIG. 1 equipped with temporary booms and hoisting cables.

In practicing the invention a plurality of booms 24 are temporarily attached about the upper portion of the tower 20, each boom extending out beyond the periphery 26 of the tower 20 as shown in the top view, FIG. 3. Each boom is supported on a central leg 28 as shown in FIGS. 1 and 2 and stabilized by a pair of wind braces or stabilizers 30, all of which are fastened to the top of the tower 20. Tieback cables 32 and hoisting cables 34 extend from the booms 24 to the center top 36 of the tower 20.

Figure 4:
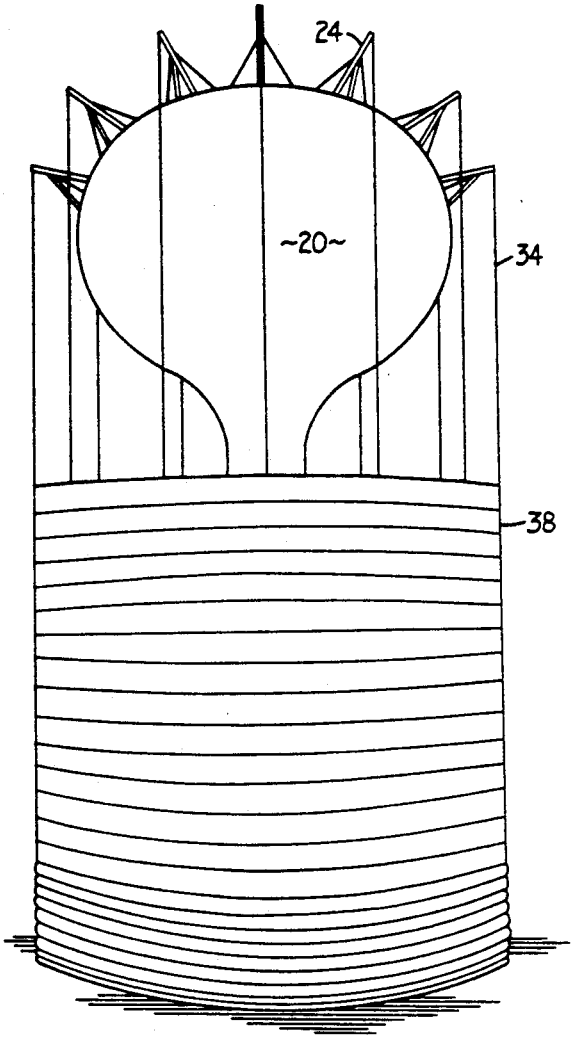
FIG. 4 illustrates the shroud partially raised about the water tower of FIG. 1.
Figure 5:
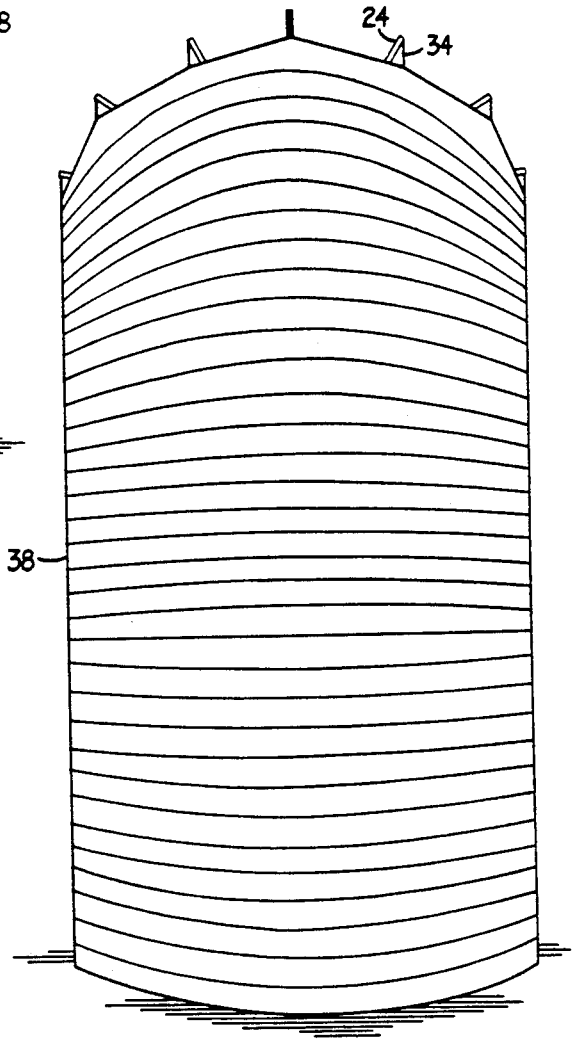
FIG. 5 illustrates the shroud fully raised about the water tower of FIG. 1.

FIGS. 2, 4 and 5 illustrate the collapsible enclosure or shroud 38 in various positions about the tower 20. In FIG. 2 the shroud 38 is shown substantially folded or collapsed about the base 22 of the tower. A plurality of hoisting cables 34 are attached to the shroud 38 adjacent the top 40 of the shroud and extend vertically to the booms 24, engaging the booms at the boom outer ends.

The shroud 38 is raised by simultaneously raising the plurality of hoisting cables 34. As the hoisting cables 34 raise the shroud 38 the shroud unfolds at the base 22 of the tower 20 as shown in FIG. 4. The shroud 38 is shown fully raised about the tower in FIG. 5. In his manner the shroud 38 which comprises multiple panels of cloth or plastic may be raised and lowered on a daily basis as work on the tower progresses or the shroud can be quickly lowered in the event the wind velocity about the tower becomes too large to safely work on the tower within the raised shroud.

Figure 6:
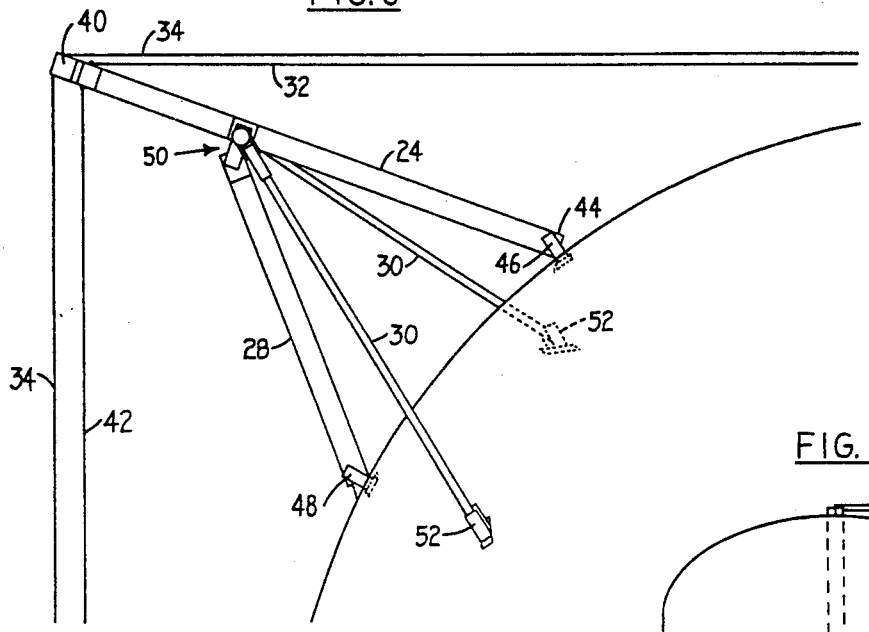
FIG. 6 is a perspective view of a boom assembly mounted on a water tower.
Figure 7:
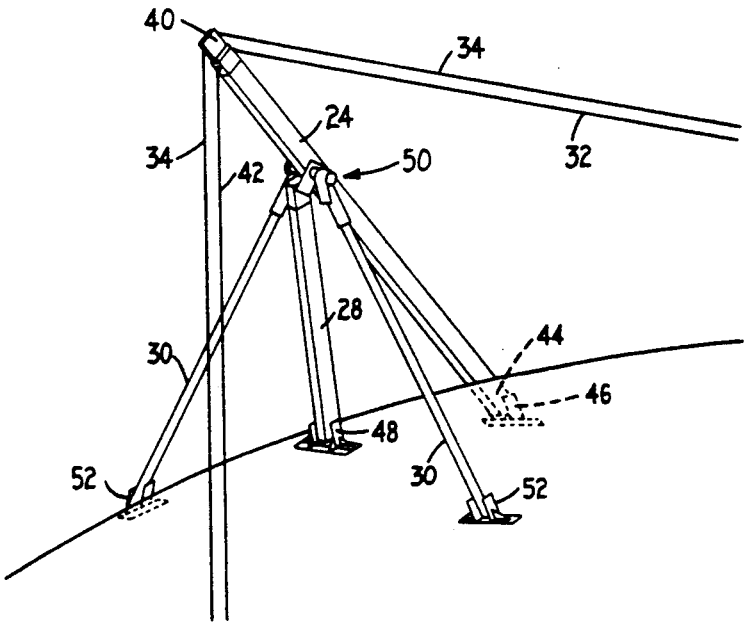
FIG. 7 is a second perspective view of a boom assembly mounted on a water tower.

Illustrated in perspective in FIGS. 6 and 7 is a typical boom 24 shown with a hoisting cable 34 passing over the outboard end 40 of the boom. Also attached to the boom 24 at the outboard end is a tie back cable 32 and a vertical guide cable 42. The inboard end 44 of the boom 24 is attached to the ellipsoidal steel plate surface of the tower 20 by a metal foot 46. As best shown in FIG. 6 the outboard end 40 of the boom 24 extends out beyond the maximum periphery of the tower 20 with sufficient clearance for the skyhook platform of the sandblast and spray paint crews. The central leg 28 supports the boom 24 downward thrust and is attached by a foot 48 to the surface of the tower 20. A pair of side wind braces 30 are connected to the boom 24 by the same attachment generally denoted by 50 as the central leg 28. Each of the wind braces 30 is similarly attached to the tower surface by feet 52.

Figure 10:
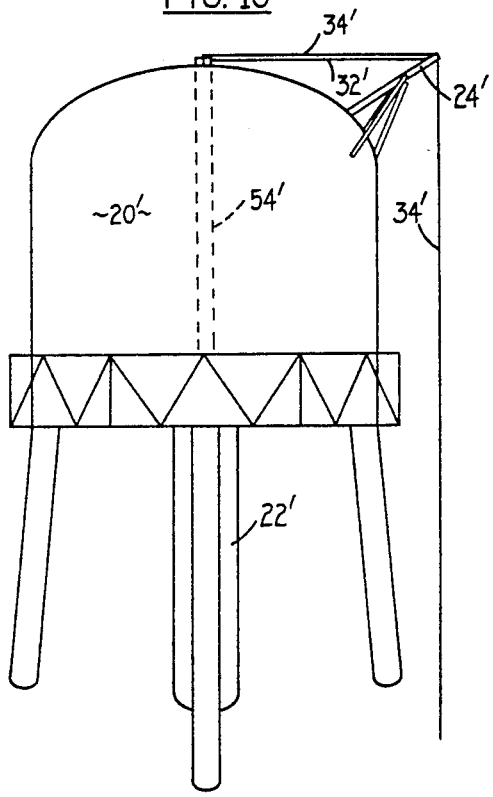
FIG. 10 illustrates a boom mounted on a multiple leg water tower.
Figure 8:
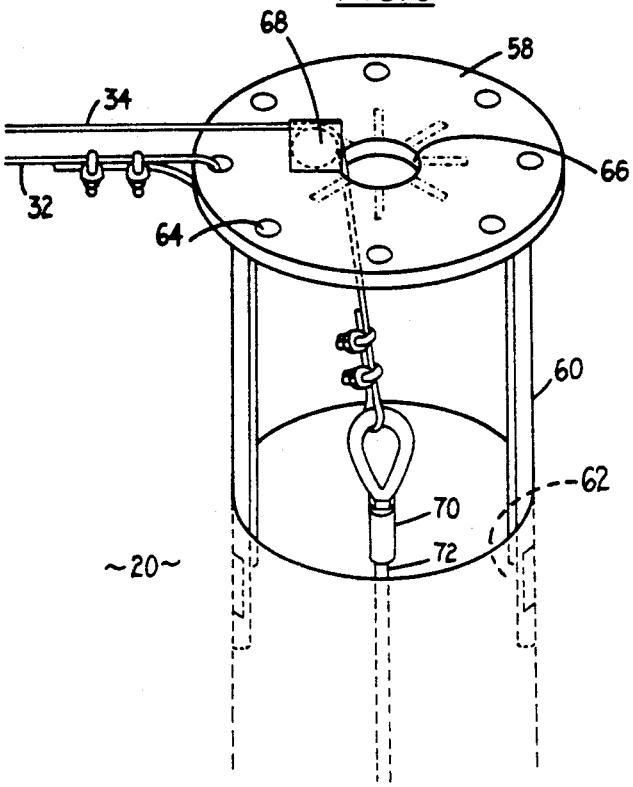
FIG. 8 is a detail of the hoisting pully assembly at the top center of a water tower.
Figure 9:
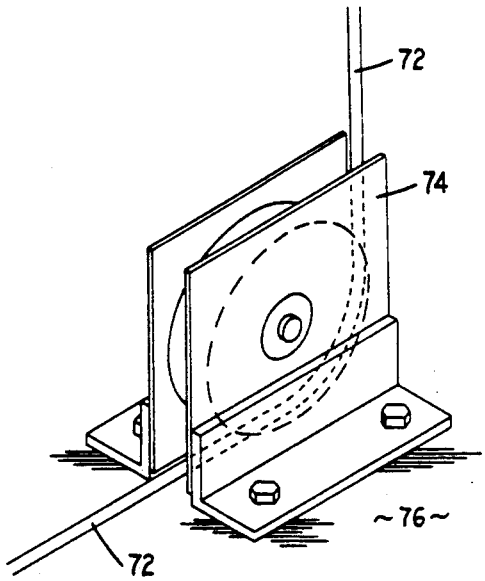
FIG. 9 is a detail of the pulley assembly at the base of a water tower.

The contemporary ellipsoidal water tower 20 of FIG. 1 and the more traditional multileg water tower 20' of FIG. 10 typically are equipped with a central riser 54' that extends to a covered opening at the center top 36 (FIG. 3) of the tower. The central riser 54 provides access to the top of the tower 20 without the need for an external ladder or lifting means. As shown in FIG. 8 the opening 56 to the central riser 54 is used to support a circular plate 58 attached by legs 60 to the opening 56 sides 62. The circular plate 58 includes a plurality of holes 64 to engage a plurality of the tie back cables 32 one of which is shown in FIG. 8.

Mounted about a central hole 66 in the circular plate 58 are a plurality of sheave assemblies 68 one of which is shown and the others of which indicated by dot-dash outline. The hoisting cables 34 pass over the sheave assemblies 68 and down through the hole 66. The plurality of hoising cables 34 are joined by fittings at 70 to a single down cable 72. The single down cable 72 extends to the base 22 of the tower 20 where the down cable 72 passes under a sheave assembly 74 in turn anchored to the floor 76 as shown or otherwise lashed in place. The sheave assembly 74 is inside the central leg of the tower 20. The down cable 72 then extends horizontally to a hoisting engine (not shown).

Figure 11:
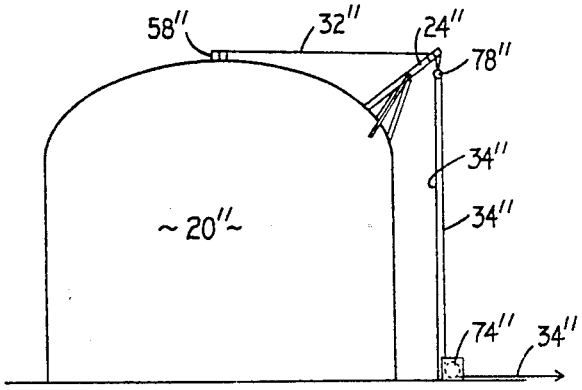
FIG. 11 illustrates a boom mounted on a large ground supported petroleum storage tank.

FIGS. 10 and 11 illustrate alternate forms of water towers and liquid storage tanks to which the method and apparatus for enshrouding a large vertical structure may may be applied. FIG. 10 illustrates a multileg tower 20' having a central riser 54' through the tank and a central column 22' therebelow. As illustrated by the single boom 24', tie back 32' and hoisting cable 34' the boom assemblies disclosed above can be applied to this traditional form of water tower 20' in the same manner as with the contemporary tower.

FIG. 11 illustrates a large ground based storage tank 20'' not equipped with a central riser. The booms 24'' and tie backs 32'' are mounted as disclosed above, however, the circular plate 58'' is merely welded to the top of the tank 20''. Each hoisting cable 34'' passes around a secondary block 78" and down to a pulley assembly 74" attached firmly to the ground. The hoisting cables 34" are then led to one or more hoisting engines (not shown). With very large diameter tanks only a portion of the periphery may be enshrouded and the tank need not be simultaneously equipped with booms 24" all around.

Figure 12:
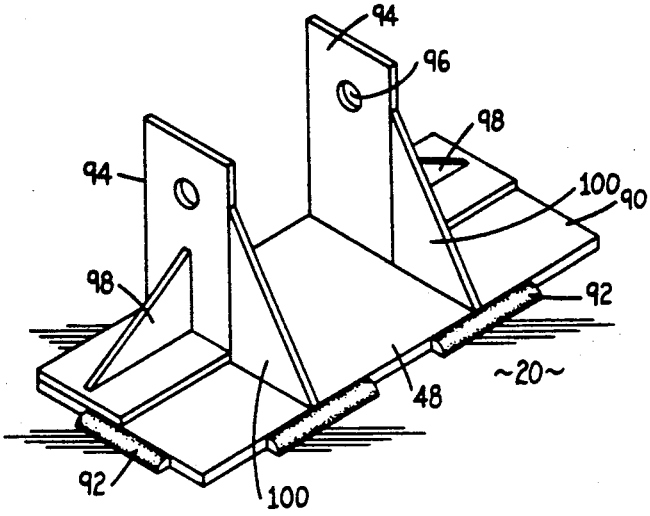
FIG. 12 is a center foot pad for the boom assembly.
Figure 13:
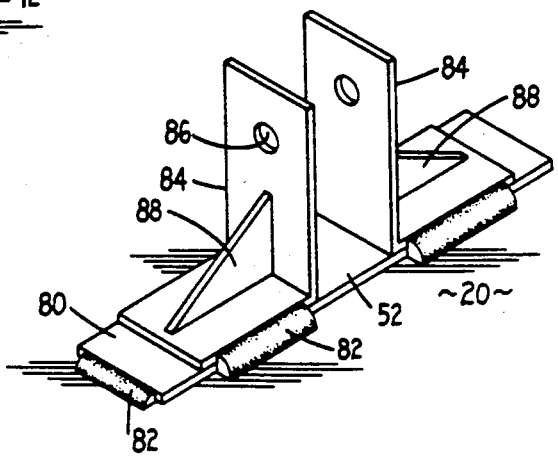
FIG. 13 is a peripheral foot pad for the boom assembly.

FIGS. 12 through 19 illustrate detailed features of the apparatus for enshroudment to be particularly effective. FIGS. 12 and 13 illustrate attachment feet or pads (46, 48 and 52 in FIGS. 6 and 7) for the boom assemblies. The pad 52 of FIG. 13 comprises a horizontal plate 80 that is temporarily welded 82 to the surface of the tower 20. Permanently welded to the plate 80 are a pair of brackets 84 perforated at 86 for bolt or pin attachment to the wind braces 30. Gussets 88 are permanently welded inside the brackets 84 for added stiffness. The pad of FIG. 13 may also be used to attach the inboard end 44 of the boom 24 to the tower surface.

The pad 48 of FIG. 12 comprises a wider horizontal plate 90 also temporarily welded 92 to the tower surface. Permanently welded to the plate 90 are a pair of brackets 94 perforated at 96 for bolt or pin attachment to the central leg 28. Gussets 98 are permanently welded inside the brackets 94 for added stiffness. Because of the major thrust load on the central leg 28, the horizontal plate 90 is extended in width to accommodate a second pair of gussets 100 permanently welded to the brackets 94 and plate 90. The pad of FIG. 12 may also be used to attach the inboard end 44 of the boom 24 to the tower.

Figure 14:
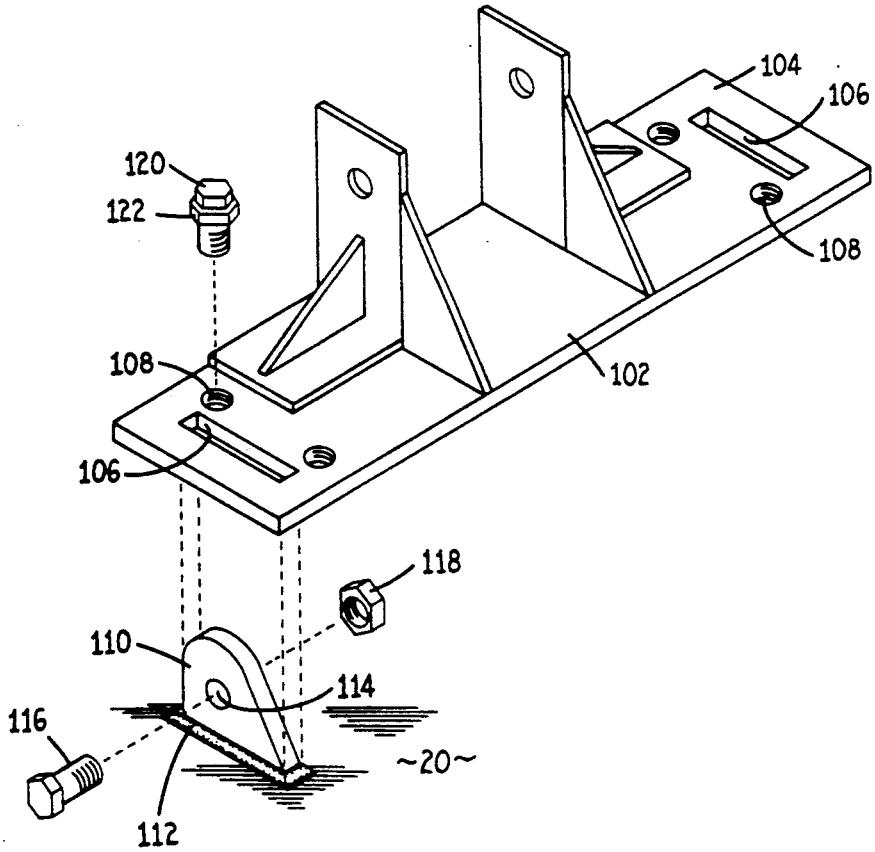
FIG. 14 is an alternate form of the foot pad of FIG. 12.

The pads 48 and 52 (FIG. 8) are welded to the tower surface prior to mounting of the boom assemblies on the tower and removed after completion of sand blasting and spray painting by cutting the welds 82 and 92. The weld points are then spot painted. As an alternative to the welding and removal FIG. 14 illustrates a pad 102 similar to the pad 48 in FIG. 12. Pad 102 horizontal plate 104, however, is larger and equipped with slots 106 at the ends thereof and a pair of threaded holes 108 adjacent each slot 106. The pair of slots 106 are adapted to engage a pair of brackets 110 permanently welded 112 to the tower surface. The brackets 110 are perforated 114 for a bolt 116 and nut 118 or pin inserted after the plate 104 is engaged on the brackets 110. The bolt 116 and nut 118 prevent the removal of the pad 102 from the tower surface. To provide necessary tightness and rigidity the bolts 120 are threaded through holes 108 and into tight engagement with the tower surface. The lock nuts 122 then are threaded down against the plate 104 to prevent inadvertent loosening. The brackets 110 remain a permanent part of the water tower 20 and are painted with the tower. With the alternate pad 102 of FIG. 14 the boom assemblies may be attached or removed from the tower without welding. Since sandblasting and spray painting of water towers is a periodic maintenance activity, the alternate pads 102 represent a substantial saving of time to install and remove the boom assemblies.

Figure 15:
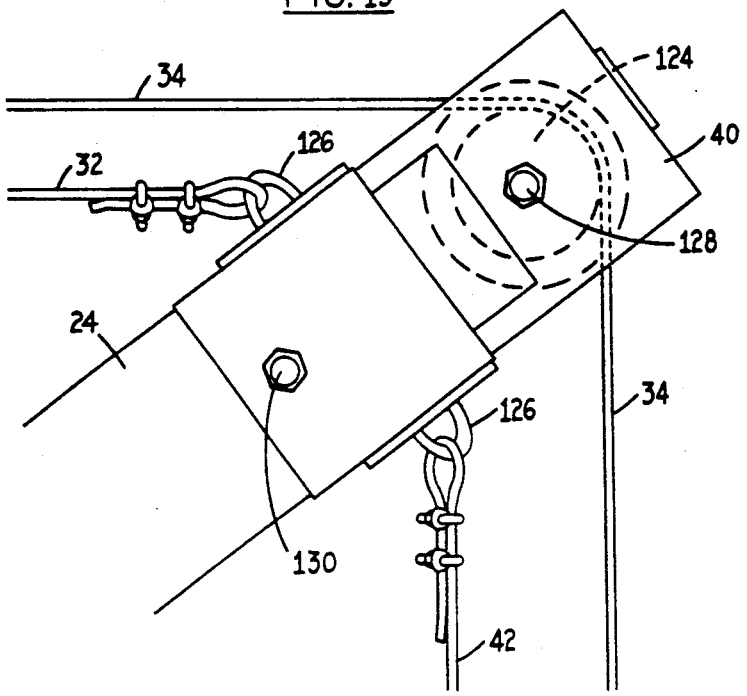
FIG. 15 is a side view detail of the boom tip.

The boom 24 outboard end 40 is depicted in FIG. 15. The hoisting cable 34 passes over a pulley 124 at the end of the boom. Eyes 126 just inside the hoisting cable 34 are attached to the boom 24 end to provide attachment locations for the tie back cable 32 and the guide cable 42. In the preferred embodiment the boom 24 is extruded structural aluminum I-section. The boom end 40 is constructed of steel plates to retain the pulley 124 with a bolt axle 128 and is attached to the boom by a bolt at 130. Aluminum is used for the boom 24 and central leg 28 to eliminate a substantial portion of the boom assembly weight.

Figure 16:
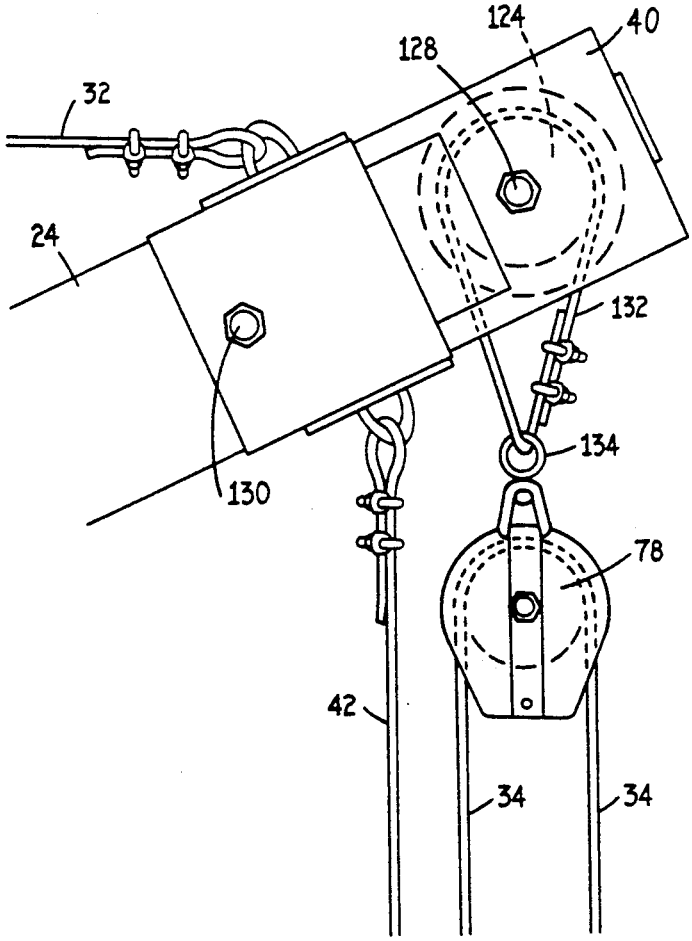
FIG. 16 is a side view detail alternate configuration of the boom tip.

FIG. 16 illustrates the boom end 40 modified for used with the tank illustrated in FIG. 11. In particular a separate block 78 supports the hoisting cable therearound adjacent the guide cable 42. The block 78 in turn is supported by a short length of cable 132 looped through the block ring 134 and about pulley 124. This assembly prevents chafing of the hoisting cable 34 if the hoisting cable is wrapped directly around the pulley 124 and the boom 24 is positioned at a relatively steep angle to horizontal.

Figure 17:
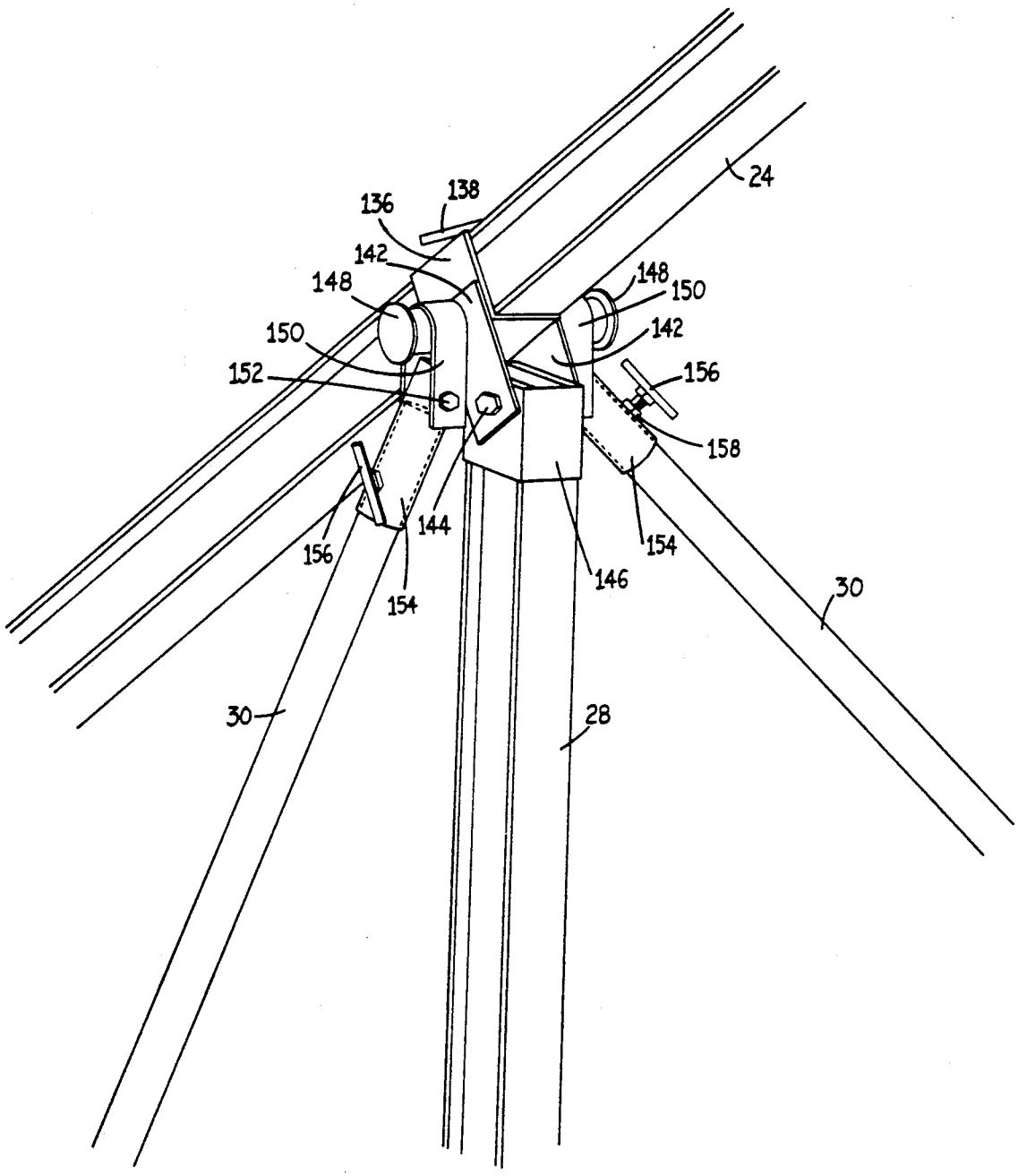
FIG. 17 is a front quarter perspective of the boom and leg adjustable joint.
Figures 18, 18A:
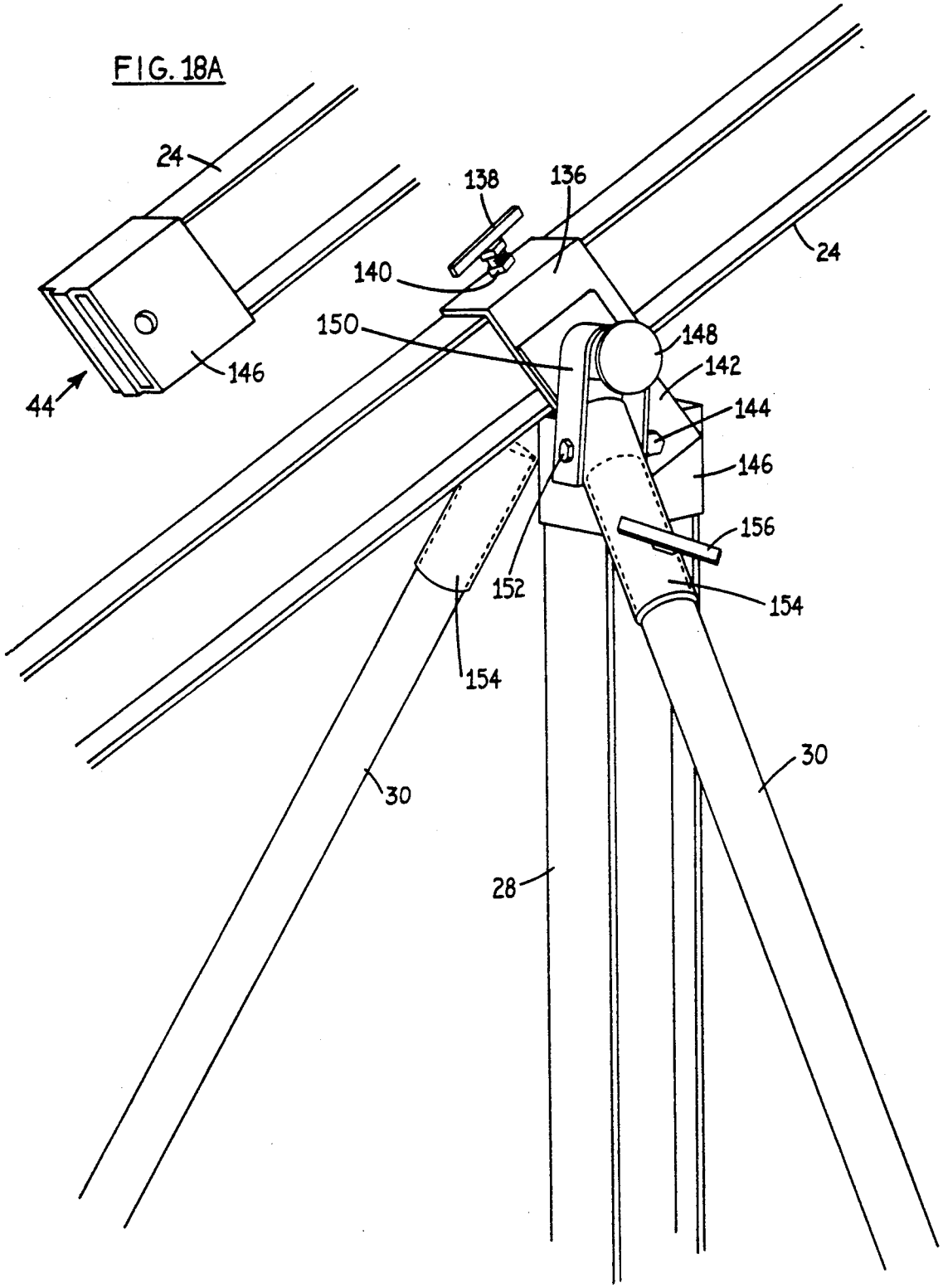
FIG. 18 is a rear quarter perspective of the boom and leg adjustable joint of FIG. 17.

FIGS. 17 and 18 illustrate the multiple adjustable attachment generally denoted by 50 wherein the central leg 28 and wind braces 30 are connected to the boom 24. A rectangular steel sleeve 136 engages the boom l-shape 24 with the boom slidable through the sleeve. To retain the boom 24 at a set position in the sleeve 136 a T-handle bolt 138 extends through a welded nut 140 and hole in the sleeve into contact with the boom 24. Attached to the sides of the sleeve 136 are a pair of steel plates 142. The steel plates 142 are perforated for a bolt connection 144 with a second sleeve or pocket 146. The second sleeve or pocket 146 is affixed to the upper end of the central leg 28 by the bolt 144. As illustrated in FIG. 18A the inward end 44 of the boom is also fitted with a sleeve or pocket 146 as is the lower end of the central support 28. The steel sleeve or pocket 146 reinforces the rotatably free mechanically fastened attachments because the boom and central support are I-section aluminum and additional load bearing support is required at the engagement of the fasteners.

On each side of the attachment 50 is a trunnion 148 welded to each plate 142 and extending outwardly. The trunnions 148 in turn are engaged by steel straps 150 which in turn are perforated to accept bolts 152. The bolts 152 engage steel cylindrical sleeves 154 in turn adjustably connected to the wind braces 30. Each sleeve 154 includes a T-handle bolt 156 and welded nut 158 for engagement with the wind braces 30. Thus, the wind braces 30 are rotatable about both the trunnions 148 and the bolts 152 and lengthwise adjustable in the sleeves 154. The central leg 28 is rotatable about the bolt 144. With this combination a wide variety of surface curvatures of water towers can be accommodated with the boom assemblies and the boom assemblies can easily be adjusted on site.

Figure 19:
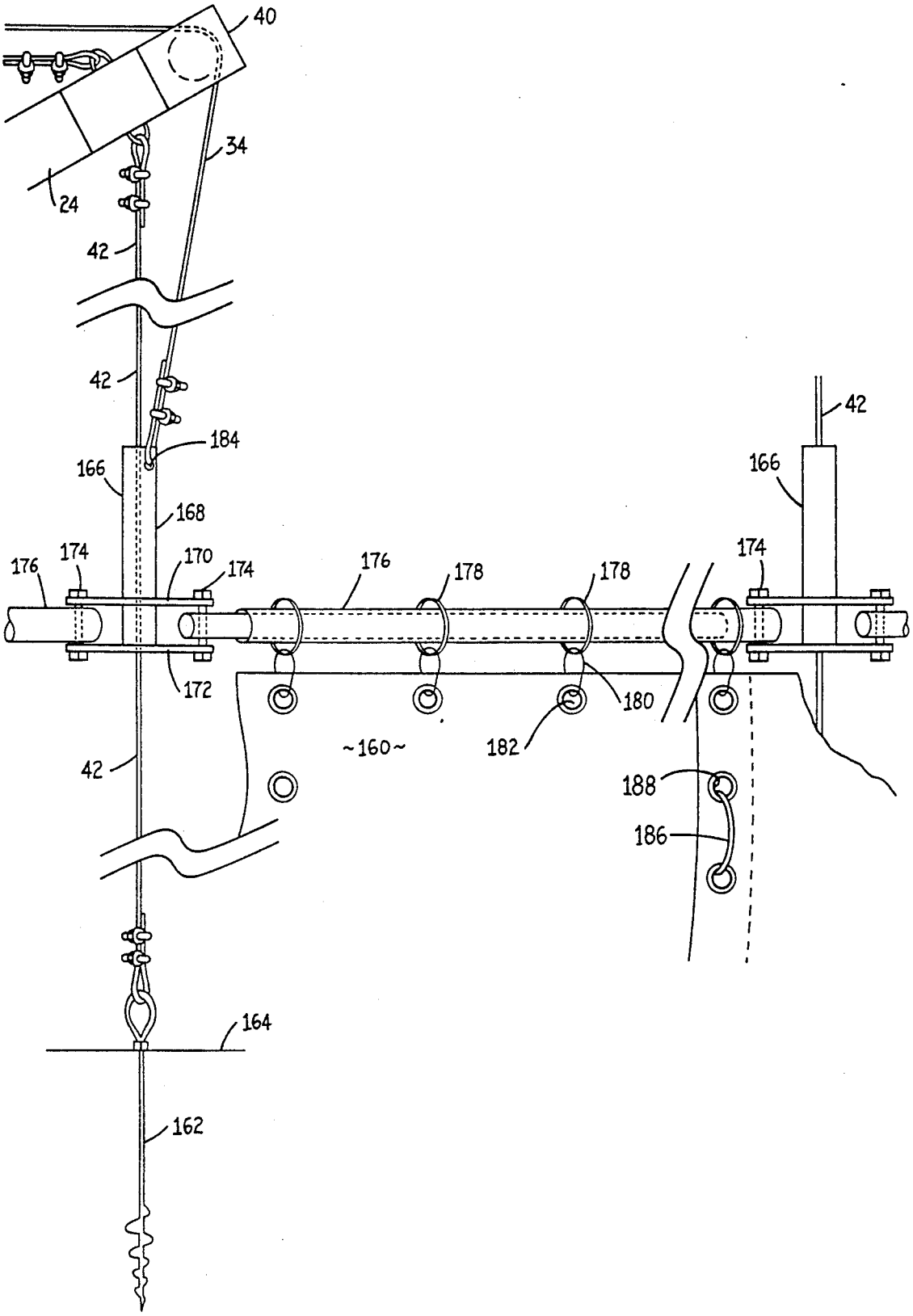
FIG. 19 is a broken away detail of the shroud panel assembly and connection to the hoisting cables.

Illustrated in FIG. 19 are details of the connection of shroud panels 160 to the hoisting cables 34 and a vertical guide cables 42. A screw anchor 162 is placed in the ground 164 to retain the lower end of each guide cable 42. One or more cable guides 166 are positioned on the guide cables 42. The cable guides comprise a steel tube 168 welded to a pair of parallel steel plates 170 and 172 to form an inverted "T" through which the guide cable 42 passes. The ends of the plates 170 and 172 are perforated to accept bolts 174 in turn connected to horizontal telescopeable rod and tube assemblies 176. The rod and tube assemblies extend between cable guides 166 on adjacent guide cables 42.

A plurality of rings 178 are placed on each rod and tube assembly 176 and latching hooks 180 connect the rings 178 to reinforced eyelets 182 in the upper edge of each panel 160. The hoisting cables 34, being attached to the cable guides 166 at 184, simultaneously raise the panels 160 with the panels evenly supported on the rod and tube assemblies 176. The adjacent vertical panels are fastened together 186 through the eyelets 188 along the adjacent vertical edges as shown in FIG. 19.

With the apparatus disclosed above, the individual panels can extend the full height of a water tower. The experimentally tested apparatus raises panels 180 feet long to reach from ground to just below the booms 24. Although full height panels have proven successful, shorter panels may be utilized by adding parallel cable guide, rod and tube assemblies about the structure between upper and lower panels. The added cable guides are also installed on the vertical guide cables 42 and connected to the hoisting cables 34 by supplemental vertical hoist cables joined to the cable guides thereabove.

Although the boom assemblies have been described in terms of their application to the compound curvature tops of water towers, it may be appreciated that the boom assemblies can be applied to flat roofs, roofs of multiple flat surfaces, and the flat or curved side walls of multi-story water towers and other structures. In the latter side wall applications the boom assembly is turned over and the pads for the stabilizers attached to the flat or curved sides well above the pad for the inboard end of the boom. Thus, the boom assemblies can be moved from structure to structure and merely readjusted for each structure as the roof or side walls require.

Figure 20:
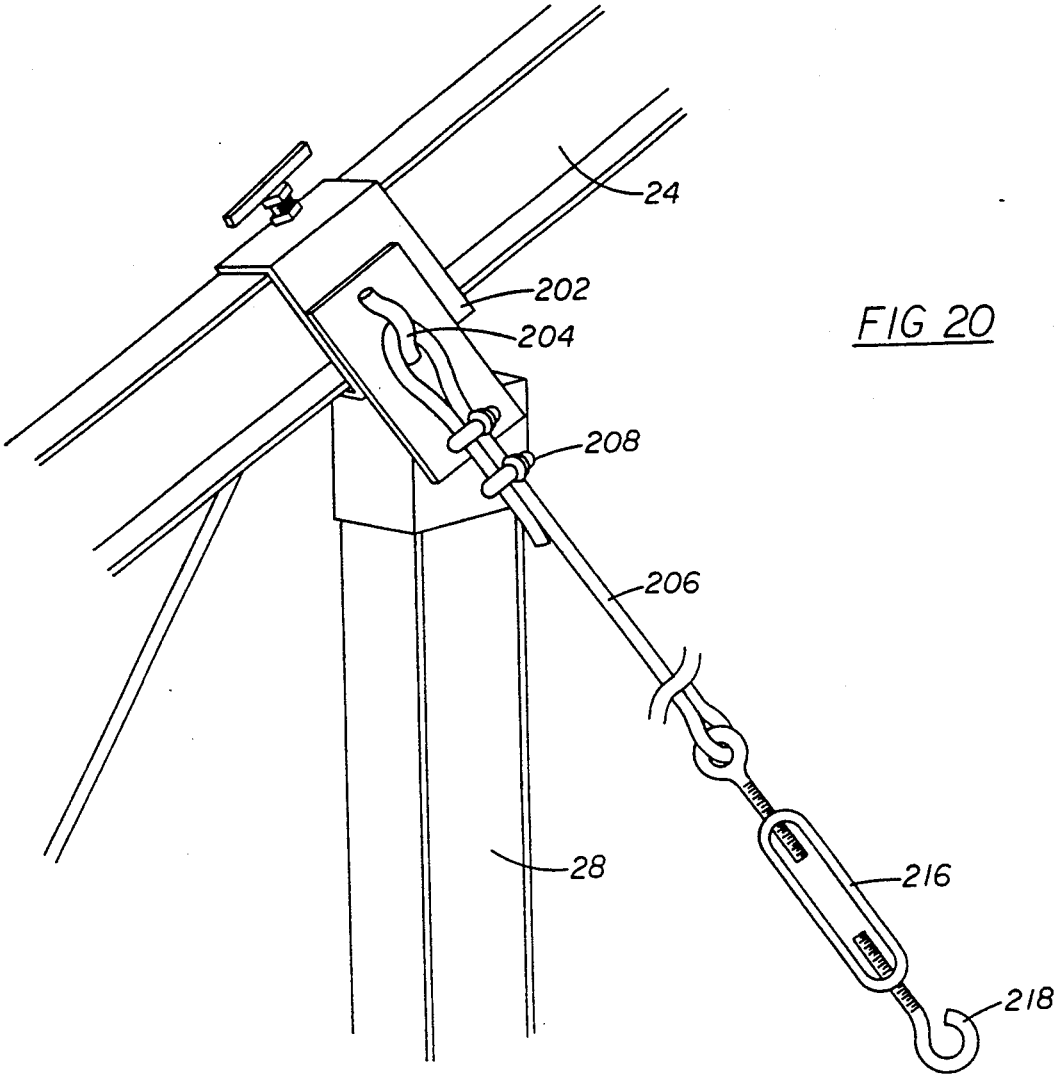
FIG. 20 is a detail in perspective of a boom assembly modified for cable stays.
Figure 21:
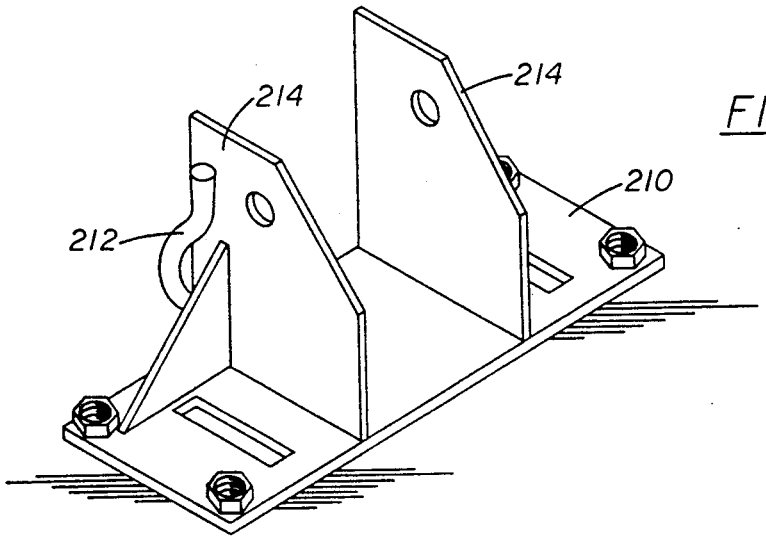
FIG. 21 is a detail in perspective of a pad modified for cable stays.
Figure 22:
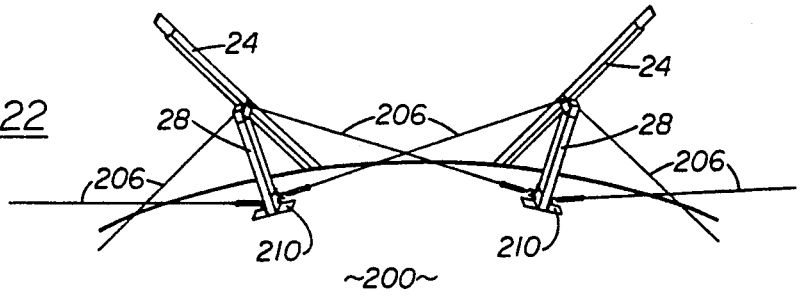
FIG. 22 is a partial perspective of cable stayed booms installed at the top of a water tower.

In FIGS. 20, 21 and 22 modified boom assemblies and their attachment to the top 200 of a water tower are illustrated. The booms 24 are supported on central legs 28 as above shown in FIGS. 6 and 7. The rectangular steel sleeve 202, however, is modified with bars 204 welded thereto on either side. The bars 204 provide for attachment of a cable 206 with cable clamps 208. The cables 206 extend to the feet or pads 210 under the central legs 28 of immediately adjacent booms 24. The feet or pads 210 are modified with curved bars 212 welded thereto on each upright plate 214 of the pads 210. Turnbuckles 216 with hooks 218 attach the cables 206 to the bars 212 and pads 210.

Figure 24:
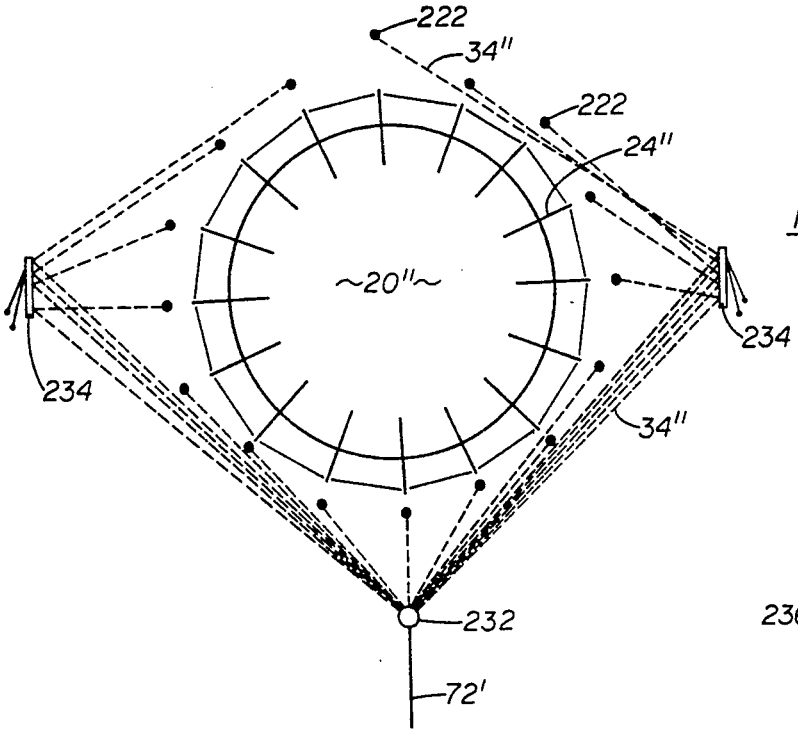
FIG. 24 is a perspective schematic of an external hoisting arrangement.
Figure 23:
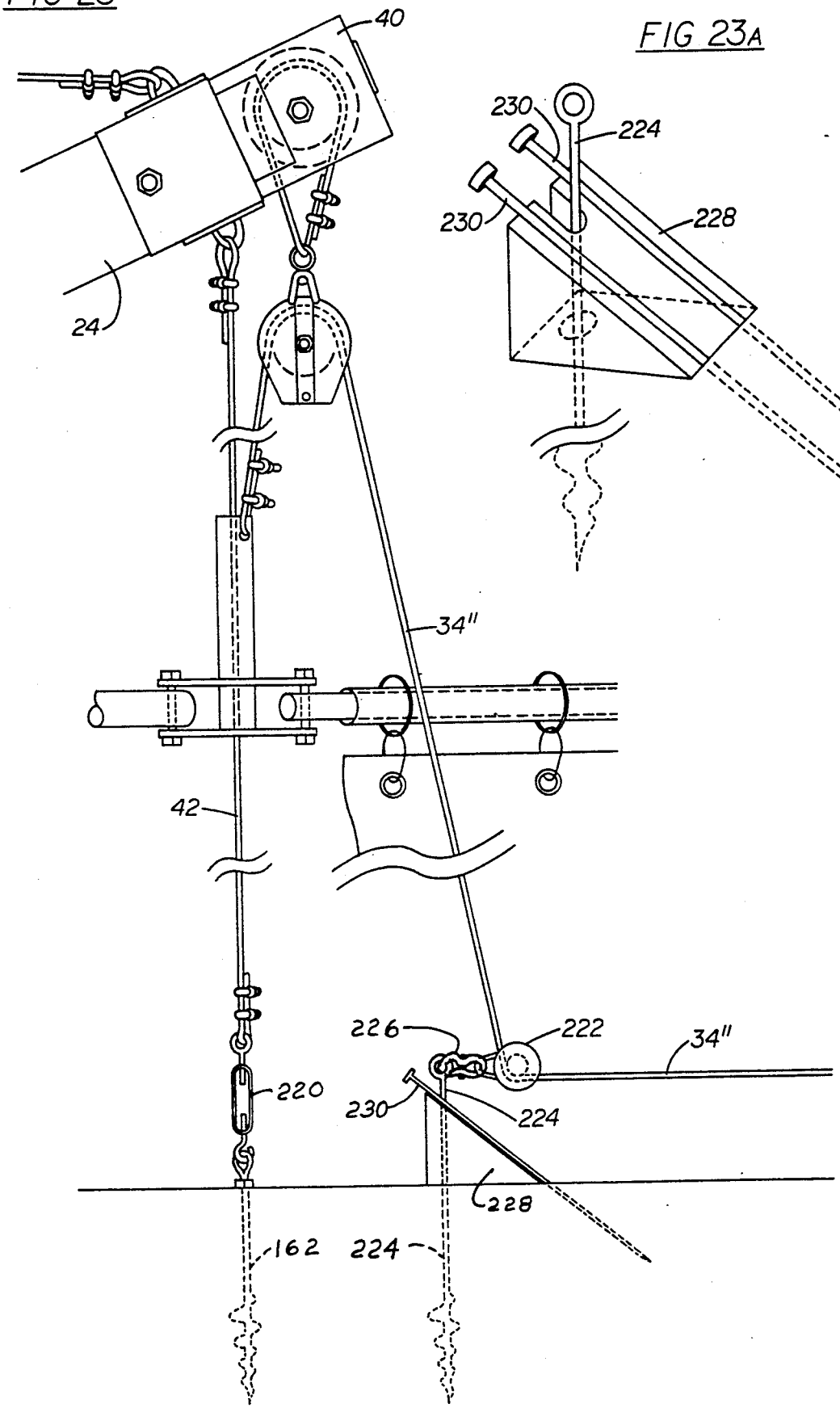
FIG. 23 is a detail of a thrust block modification for the external hoisting cables shown in FIGS. 11 and 16.
Figure 23A:
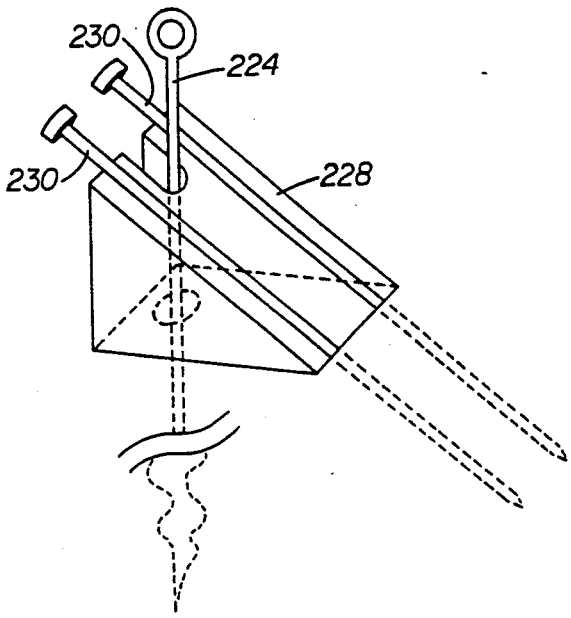
FIG. 23A is a detail in perspective of the thrust block.

Illustrated in FIGS. 23, 23A and 24 are modifications to enable a single hoisting engine to simultaneously raise a plurality of outside cables 34''. Beneath each boom 24 end 40 is a ground anchor 162 to which is attached the guide cable 42 by a turnbuckle 220. The ground pulley 222 is attached to a second ground anchor 224 by a link 226. The ground anchor 224 passes through a thrust block 228 as best shown in FIG. 23A and the thrust block 228 is further retained to the ground by a pair of large spikes 230 driven into the ground. The thrust block 228 and large spikes 230 accommodate the horizontal thrust applied to the ground anchor 224 by the outside hoisting cable 34''.

The ground anchors 224 and thrust blocks 228 may be arranged about the base of a tank or water tower 20'' as shown in FIG. 24. Each hoisting cable 34'' as shown by a dotted line extends from the pulley 222 at a ground anchor-thrust block to a common ring 232. The common ring 232 is attached to a master hoisting cable 72' leading to a hoisting engine (not shown). To reach about the water tower 20'' corner posts 234 with pulleys are provided. The pulleys 222 and ground anchor-thrust blocks are located below and just outside of the booms 24'' as shown in FIG. 24. The cable 72' length from the ring 232 to the hoisting engine must be at least equal to the vertical height to the booms 24'' of the vertical height of the shroud. Thus, the entire shroud may be raised and lowered simultaneously with a single hoisting cable 72' and engine despite the multiple hoisting cables 34'' about the outside of the water tower 20''.

Figure 25:
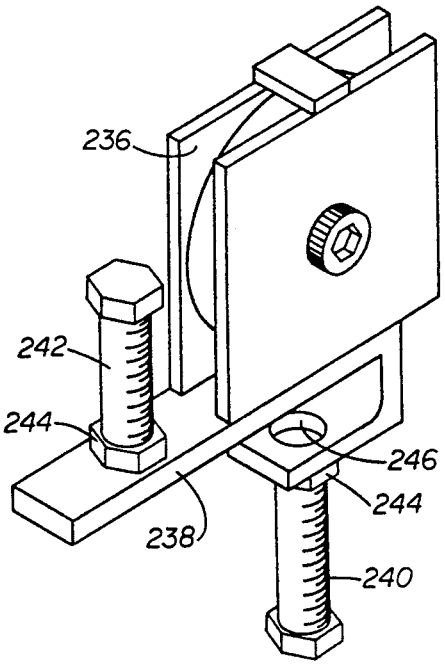
FIG. 25 is a perspective view of an adjustable sheave for the central sheave assembly at the top of a water tower (FIG. 8)
Figure 26:
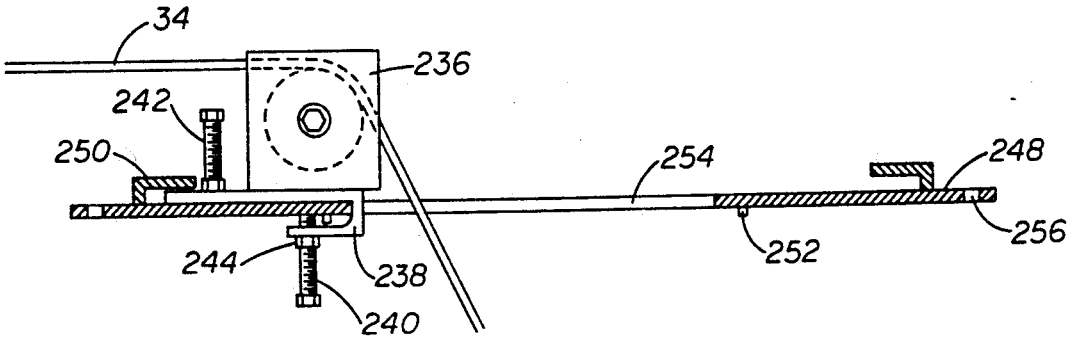
FIG. 26 is a cross-section of a modified sheave plate taken along the line 26—26 of FIG. 27.
Figure 27:
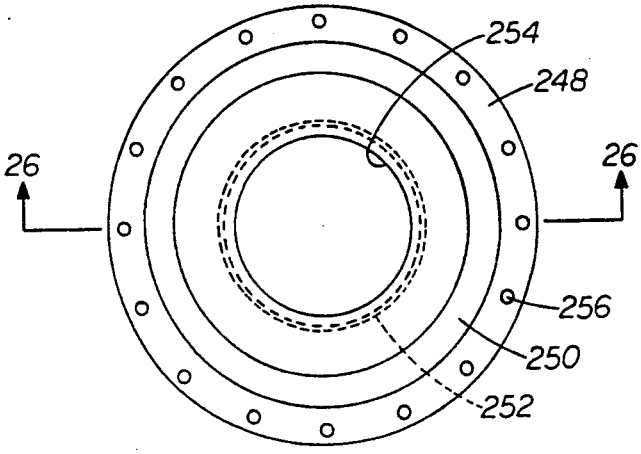
FIG. 27 is a top view of the modified sheave plate of FIG. 26.

FIG. 25 illustrates a sheave assembly or pulley block 236 having a J-shaped bracket 238 welded thereto. Bolts 240 and 242 with lock nuts 244 are attached to the bracket 238 by threaded holes 246 and the entire assembly fitted to the ring shaped modified sheave plate 248 as shown in FIGS. 26 and 27. The modified sheave plate 248 includes a circumferential hold down ring 252 underneath. As required by the number of booms on the tower and their location, the corresponding number of pulley blocks 236 are positioned about the central hole 254 of the sheave plate 248 and the bolts 240 and 242 tightened to the sheave plate. Upon tightening of bolt 240 the pulley block 236 cannot slide past the stop ring 252 and upon tightening of the bolt 242 the end of the bracket 238 engages the underside of the hold down ring 250. Thus the pulley blocks 236 may be easily and securely positioned about the sheave plate 248.

Figure 28:
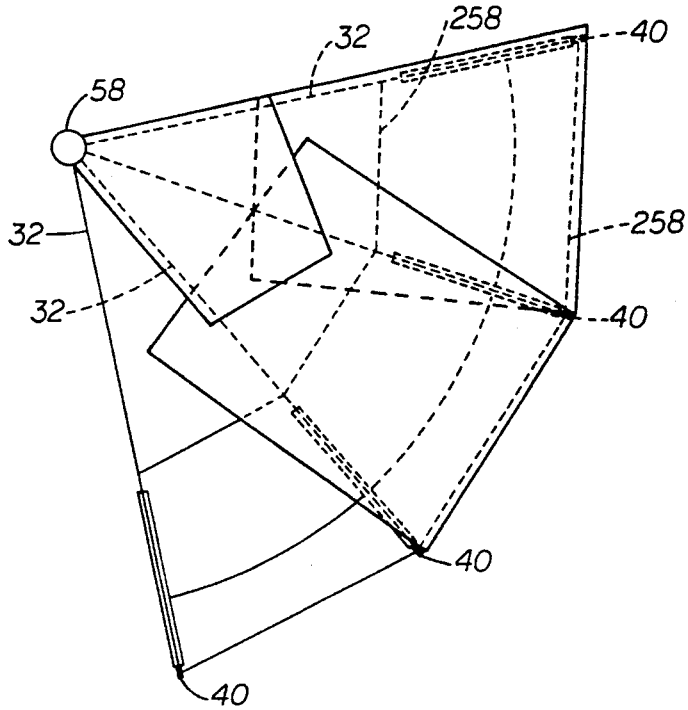
FIG. 28 shows a means of covering the top of a water tower with rectangular pieces of cloth or plastic.
Figure 29:
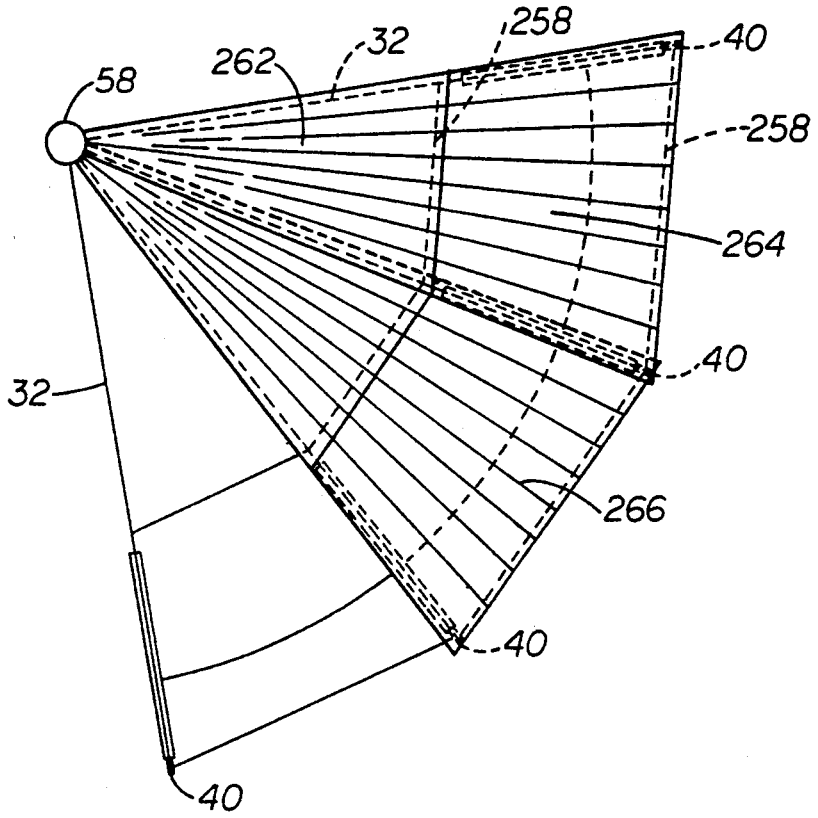
FIG. 29 shows an alternate means of covering the top of the water tower with radially pleated panels of cloth or plastic.

Illustrated in FIGS. 28 and 29 are two means of covering the top of a water tower out to the boom ends adjacent the vertical shroud. The central sheave plate 58 is connected to the boom ends 40 by tie back cables 32 as disclosed above. The central sheave plate 58 is positioned about 5 feet above the top of the water tower thereby providing clearance for workmen underneath the tie back cables 32. A plurality of circumferential cables 258 are tied to the boom ends 40 and inwardly on the tie back cables 32 to form a spiderweb pattern and support a plurality of plastic or cloth panels that form the top covering. Although only three sectors of the assembly are shown the cable assembly and covering extend over the entire top of the tower.

In FIG. 28 standard or conventional rectangular panels 260 are overlapped and tied down to the supporting tie back cables 32 and circumferential cables 258. In FIG. 29, however, the panels are triangular 262, and trapezoidal 264 and formed with radial pleats 266. With the triangular 262 and trapezoidal 264 pleated panels only minimal overlap at the edges of the panels is required and the edges can all be tied down to the cables 32 and 258 through conventional grommets along the edges of the panels. The pleats 266 allow substantial variation in the angular spread between booms and tie back cables 32 depending upon the size and number of pleats 266 in the panels 262 and 264. Thus, the triangular and trapezoidal 264 panels can be reused from tower to tower even though the angular spread between booms and number of booms changes with the size of the tower.

We claim:

1. Apparatus to temporarily enclose multistory structures comprising a plurality of booms extending outwardly about at least a portion of the structure adjacent the top of the structure, said booms extending beyond the periphery of the structure, a sheave attached at the outboard end of each boom and a vertically extending hoisting cable supported by each sheave to form a plurality of downwardly extending hoisting cables, a plurality of flexible panels, means on the panels to attach the panels together to form a panel assembly and means to attach the panel assembly to the plurality of downwardly extending hoisting cables whereby upon raising the hoisting cables, the panel assembly forms an enclosure about at least a portion of the structure, and stabilization means attached to each boom, said stabilization means extending diagonally away from each boom and attached to the structure at a location spaced horizontally from the boom to which the stabilization means is attached.

2. The apparatus of claim 1 including a central support attached to each boom, the inward end of each boom and lower end of each central support being temporarily attachable to the structure, and the attachment of the stabilization means to the structure from an adjacent boom being attachable with the attachment of the lower end of the central support to the structure.

3. The apparatus of claim 2 wherein the stabilization means comprise cables extending from booms to the structure attachments of the central supports of adjacent booms.

4. The apparatus of claim 1 including a plate, a plurality of sheaves adjustably attachable to the plate whereby the sheaves can be positioned in alignment with corresponding booms.

5. The apparatus of claim 4 wherein the plate is circular and the sheaves can be angularly positioned circumferentially about the plate to correspond with the angular position of booms on the structure.

6. The apparatus of claim 1 including a plate, means on said plate to attach tie back cables and tie back cables extending from the booms to said plate, a plurality of support cables extending substantially transversely across the tie back cables and spaced apart from the boom ends to the plate.

7. The apparatus of claim 6 including flexible panels supported on the tie back cables and support cables and temporarily fastened thereto.

8. The apparatus of claim 7 wherein the flexible panels are pleated.

9. The apparatus of claim 8 wherein the plate is circular and at least some of the pleated panels are substantially trapezoidal in shape.

10. The apparatus of claim 1 wherein each hoisting cable extends downwardly from both sides of each sheave, one of the downwardly extending portions of each cable each passing through a ground sheave anchored adjacent the base of the structure and extending to an attachment ring for the plurality of hoisting cables whereby all the hoisting cables may be simultaneously actuated to raise and lower the panel assembly.

11. The apparatus of claim 10 wherein the ground sheave is anchored by a ground anchor extending through a thrust block.

12. As a part of an apparatus to temporarily enclose multi-story structures, an adjustable boom assembly for temporary attachment to multi-story structures having surfaces of compound curvature, said boom assembly comprising a boom, a sleeve on said boom and means to affix the sleeve at selectable locations on said boom, a central support rotatably attached to said sleeve, a pair of trunnions attached to opposite sides of said sleeve, a stabilizer rotatably attached to each trunnion, said stabilizer attachments also including means for rotation in a direction perpendicular to the rotational axis of said trunnions and means to adjustably lengthen said stabilizers.

13. The adjustable boom assembly apparatus of claim 12 including pads rotatably attached to the boom, central support and stabilizers, said pads temporarily attachable to the multi-story structure.

14. The adjustable boom assembly apparatus of claim 13 including brackets permanently attachable to the multi-story structure, said pads including mechanical fastening means to temporarily attach the pads to the brackets.

15. As a part of an apparatus to temporarily enclose multi-story structures, an adjustable boom assembly for temporary attachment to multi-story structures, said boom assembly comprising a boom, a sleeve on said boom and means to affix the sleeve to the boom at selectable locations on said boom, a pair of stabilizers and stabilizer attachments attached to either side of said sleeve, said stabilizer attachments including means for two degrees of rotational freedom and telescopic extension means for each stabilizer, attachment pads rotatably connected to said boom and each stabilizer, said attachment pads temporarily attachable to the multi-story structure.

16. The adjustable boom assembly apparatus of claim 15 including brackets permanently attachable to the multi-story structure, said attachment pads including mechanical fastening means to temporarily connect the attachment pads to the brackets.

17. As a part of an apparatus to temporarily enclose multi-story structures, an adjustable attachment for a boom assembly comprising a sleeve, through which a boom may be positioned, and tightening means on the sleeve to selectably position a boom in the sleeve, a pair of trunnions extending to either side of said sleeve, means rotatably engaging each trunnion, and each means rotatably engaging each trunnion also including connection means to a pair of stabilizers, said connection means rotatable about an axis different from the trunnion axis and including means to engage and retain a stabilizer.

18. The adjustable attachment of claim 17 including a connection on said sleeve rotatable about an axis parallel to the trunnion rotational axis, said parallel rotatable axis connection including means to connect a central support.

19. The adjustable attachment of claim 17 including means to adjust the length of a stabilizer.

20. As a part of an apparatus to temporarily enclose multistory structures, an adjustable boom assembly for temporary attachment to multi-story structures, said boom assembly comprising a boom, a sleeve on said boom and means to affix the sleeve at selectable locations on said boom, adjustable stabilization means attached to the boom sleeve and extendable diagonally away from the boom for attachment to the structure and a central support attached to the sleeve, said central support rotatable relative to the sleeve about a transverse axis.

21. The adjustable boom assembly apparatus of claim 20 including a pad for attachment of the central support to the structure, the pad including means to attach stabilization means from adjacent boom assemblies.

22. A method to enshroud large multi-story structures comprising the steps of:

attaching a plurality of booms at the top of the structure, the booms extending beyond the periphery of the structure, attaching a plurality of vertical guide cables and hoisting cables to the booms, the guide cables being anchored adjacent the base of the structure and the hoisting cables being attachable to a panel assembly, attaching a panel assembly to the guide cables and hoisting cables, and hoisting the panel assembly up toward the booms to enshroud the structure.

* * * * *